US007107644B1

(12) United States Patent
Bahl, Jr.

(10) Patent No.: US 7,107,644 B1
(45) Date of Patent: Sep. 19, 2006

(54) DUST MOP WITH DETACHABLE SCRAPER

(75) Inventor: John Andrew Bahl, Jr., 816 Lebonan, Aurora, IL (US) 60505

(73) Assignee: John Andrew Bahl, Jr., Aurora, IL (US)

( * ) Notice: Subject to any disclaimer, the term of this patent is extended or adjusted under 35 U.S.C. 154(b) by 0 days.

(21) Appl. No.: 11/210,642

(22) Filed: Aug. 25, 2005

(51) Int. Cl.
*A47L 13/12* (2006.01)

(52) U.S. Cl. ..... 15/105; 15/111; 15/228

(58) Field of Classification Search ..... 15/111, 15/105, 115, 228, 246
See application file for complete search history.

(56) References Cited

U.S. PATENT DOCUMENTS 2,290,178 A * 7/1942 Hayford ..... 15/111
3,733,636 A * 5/1973 Osadsky ..... 15/111
5,502,857 A * 4/1996 Jubinville ..... 15/111

* cited by examiner

*Primary Examiner*—Gary K. Graham

(57) ABSTRACT

A long handled scraper clamped onto a broom and/or dustmop handle.

1 Claim, 2 Drawing Sheets

DUST MOP WITH DETACHABLE SCRAPER

FIELD OF THE INVENTION

The present invention relates to and, more particularly, to Custodial/Janitorial assistance in schools, industrial settings, gymnasium floors, cafeterias and any large public arenas.

BACKGROUND OF THE INVENTION

While a school custodian is sweeping/dusting the floors he comes upon a piece of gum stuck on the floor. There are spit balls on the walls and ceiling that need scraped down as well. The custodian may also find a pencil stuck in the ceiling tile. The custodian must stop what he is doing to take care of his findings. With the Busterduster and Busterbroom, the custodian just pulls off the long handled scraper, scrapes up the object, then continues along sweeping or dusting the floors.

Currently most custodians carry scrapers in their back pockets.

With the current process the custoidan has to bend over to scrape up the gum, or climb a ladder to scrape the spit balls off the walls and ceilings. The extra bending and climbing risk injuries to the custodian and takes away precious time from his job.

It is therefore an object of the invention to aid maintenance workers at scraping up gum and such stuck on floors, walls and ceilings.

It is another object of the invention to provide a broom or mop with a scraper attached.

It is another object of the invention to eliminate work related injuries from bending over and climbing ladders, risking falls.

It is another object of the invention to expedite required work hours saving on overtime pay.

SUMMARY OF THE INVENTION

In accordance with the present invention, there is provided a long handled scraper clamped onto a broom and/or dustmop handle.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
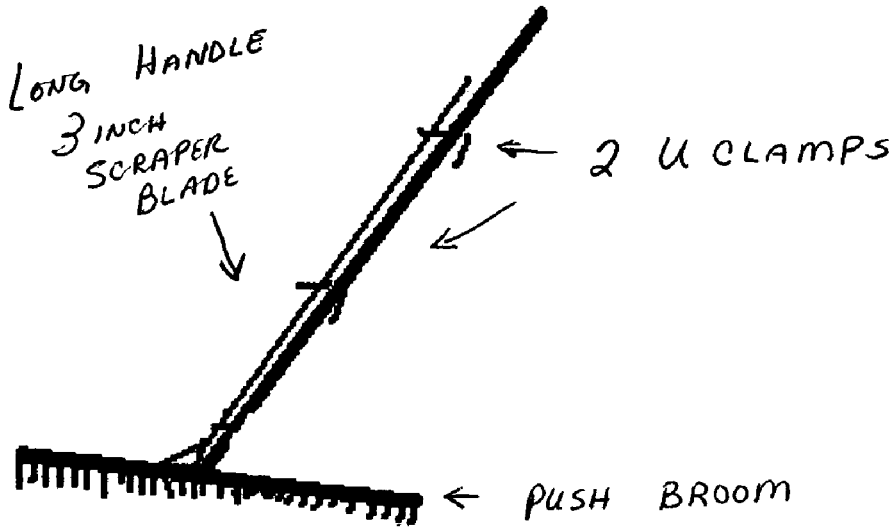
FIG. 1 is a front view of the Bahl Busterbroom is a push broom with a long handled scraper attached with 2 clamps for easy removal of stuck on objects.

FIG. 1 is a front view of the Bahl Busterbroom is a push broom with a long handled scraper attached with clamps for easy removal of stuck on objects.

Figure 2:
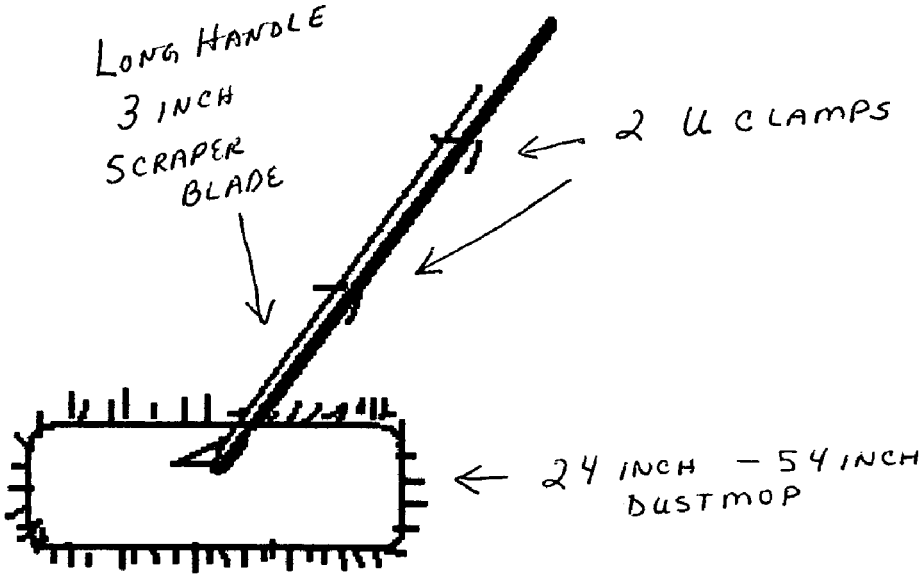
FIG. 2 is a front view of the Bahl Busterduster is a floor mop with a long handled scraper attached with 2 clamps for easy pull off for scraping up.

FIG. 2 is a front view of the Bahl Busterduster is a dust mop with a long handled three inch scraper attached with two U-shaped clamps for easy pull off for scraping up.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A floor and wall cleaning assembly, said assembly comprising:

a dust mop, said dust mop including;

a generally rectangular dust mop head having an upper and lower surface, an elongated handle attached at one end centrally to said upper surface of said head, a pair of U-shaped clamps attached to said handle at spaced locations along the length of said handle, a scraper, said scraper including;

a 3 inch wide scraper blade, an elongated handle attached at one end to said scraper blade, wherein the elongated handle of the scraper is releasable received in and held by said spaced U-shaped clamps such that said scraper blade lies above said upper surface of said head adjacent said attachment of the dust mop handle to the dust mop head, said scraper can be detached from the dust mop for individual, distinct use without movement of said dust mop.

* * * * *